US007731042B2

(12) United States Patent
Blomdahl et al.

(10) Patent No.: US 7,731,042 B2
(45) Date of Patent: Jun. 8, 2010

(54) CLOSURE WITH HINGED LID AND STRESS RELIEF RECESSES

(75) Inventors: Cori M. Blomdahl, Muskego, WI (US); Stacy L. Beilke, Eagle, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 606 days.

(21) Appl. No.: 11/313,490

(22) Filed: Dec. 21, 2005

(65) Prior Publication Data

US 2007/0138123 A1 Jun. 21, 2007

(51) Int. Cl.
*B65D 41/00* (2006.01)

(52) U.S. Cl. ..... 215/235; 215/236; 220/254.5; 222/556

(58) Field of Classification Search ..... 215/235, 215/236; 220/254.5; 222/556
See application file for complete search history.

(56) References Cited

U.S. PATENT DOCUMENTS

| | | | | | |
|---|---|---|---|---|---|
| 4,403,712 | A * | 9/1983 | Wiesinger | 220/839 |
| 5,148,912 | A * | 9/1992 | Nozawa | 220/838 |
| 5,257,708 | A * | 11/1993 | Dubach | 220/827 |
| 5,361,920 | A * | 11/1994 | Nozawa et al. | 215/237 |
| 5,386,918 | A * | 2/1995 | Neveras et al. | 215/235 |
| 5,435,456 | A * | 7/1995 | Dubach | 220/838 |
| 5,437,383 | A * | 8/1995 | Stull | 215/235 |
| 5,489,035 | A * | 2/1996 | Fuchs | 215/235 |
| 5,558,239 | A * | 9/1996 | Dubach | 215/235 |
| 5,642,824 | A * | 7/1997 | Hess et al. | 215/235 |
| 5,785,193 | A * | 7/1998 | Kobayashi et al. | 215/235 |
| 5,913,435 | A * | 6/1999 | Fuchs | 215/237 |
| 6,152,320 | A * | 11/2000 | Hierzer et al. | 220/838 |
| 6,321,923 | B1 * | 11/2001 | Wood | 215/235 |
| 6,439,410 | B1 * | 8/2002 | Dubach | 215/235 |
| 6,460,726 | B1 * | 10/2002 | Hierzer et al. | 220/838 |
| 6,631,820 | B2 * | 10/2003 | Harrold et al. | 215/237 |
| 6,971,531 | B1 * | 12/2005 | Dubach | 215/235 |
| 7,048,158 | B2 * | 5/2006 | Hierzer | 222/546 |
| 7,051,905 | B2 * | 5/2006 | Hierzer | 222/546 |
| 7,281,638 | B2 * | 10/2007 | Hierzer et al. | 220/257.1 |
| 2001/0035389 | A1 * | 11/2001 | Anderson | 215/235 |
| 2004/0016714 | A1 * | 1/2004 | Wood et al. | 215/235 |
| 2005/0067366 | A1 * | 3/2005 | Dubach | 215/235 |
| 2006/0201904 | A1 * | 9/2006 | Comeau et al. | 215/237 |

OTHER PUBLICATIONS

Seaquist Closures Drawing EDD-1330-F, Sheet 2 of 3.

* cited by examiner

*Primary Examiner*—Anthony Stashick
*Assistant Examiner*—Christopher B McKinley
(74) *Attorney, Agent, or Firm*—Wood, Phillips, Katz, Clark & Mortimer

(57) ABSTRACT

A closure is provided for a container opening. The closure includes a body for mounting to the container and a lid movable between a closed position and an open position. The lid and body are connected by a bistable, snap-action hinge structure having a web between two hinges. Stress-relief recesses are provided at an end edge of either the body hinge or the lid hinge or both.

9 Claims, 7 Drawing Sheets

CLOSURE WITH HINGED LID AND STRESS RELIEF RECESSES

TECHNICAL FIELD

This invention relates to a hinge structure for connecting two members, and the hinge structure is particularly suitable for joining a container closure lid to the container closure body.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a bistable hinge structure connecting a lid to a base mounted over the container opening. The hinge structure has a snap-action biasing force which maintains the lid in a selected closed or open position.

A hinge structure for a closure disclosed in U.S. Pat. No. 4,403,712 has a single, main geometric axis hinge and has two webs each defined by two hinges which diverge on either side of the web.

A snap-action hinge structure with significant improved operating characteristics is a dual axis hinge structure disclosed in the U.S. Pat. No. 5,642,824. The hinge structure is of the type that includes a web having a narrow central portion between two wider ends. An arcuate hinge connects a closure base to the web along one side of the web between the hinge ends. An arcuate hinge connects the closure lid to the web along another side of the web between the hinge ends. The hinge structure includes at least one abutment surface located so that when the lid is in the closed position, the abutment surface extends adjacent the web central portion from near one of the hinges toward the other hinge. During the closing and opening of the lid, the abutment surface is contacted by the web central portion whereby the position of the web is controlled.

Another snap-action, dual axis hinge structure with an improved design is disclosed in U.S. Pat. No. 6,321,923. The hinge structure includes a web having a narrow, central portion between two wider ends which each defines a lateral edge. The hinge structure also includes a first arcuate hinge connecting the closure lid to the web along one side of the web between the lateral edges. The hinge structure includes another arcuate hinge connecting the closure base to the web along another side of the web between the lateral edges. The web has two spaced-apart regions of reduced thickness. The reduced thickness regions are located between, and are reduced in thickness relative to, the arcuate hinges. Each reduced thickness region extends to one of the adjacent, lateral edges. The hinge structure has enhanced resistance to fracture or failure. The improved resistance to failure results from a configuration that provides a particular distribution of stress along the outer or lateral edges of the hinge structure and a concomitant reduction in stress at the points where the outer edges of the hinge structure are connected to the two members, such as a closure body and a closure lid. Although such a hinge structure functions with improved operating characteristics, there are some applications, such as those involving a large number of opening and closing cycles, in which the dual axis hinge structure (as well as other biased hinge structures or bistable, snap-action hinge structures) may be more likely to fail or break.

It is believed that in a snap-action hinge structure which includes two or more hinges and includes a web having at least one wide end, the stresses are greater and/or are unevenly distributed, along the lateral edges of the web and at the corners of the web where each of the hinges terminates. Failure or fracture of such hinge structures is typically initiated at those regions where a lateral edge of the hinge structure web connects with the closure body and/or lid at the end of each hinge.

Thus, it would be desirable to provide an improved snap-action hinge design in which the stresses in the hinge structure could be more carefully controlled. In particular, it would be beneficial if such an improved design could provide a lower stress, or reduced stress concentration, at each opposite end of the hinge structure.

It would be especially desirable to provide a hinge structure which would have reduced stresses at the opposite ends of each of two hinges in a dual axis hinge structure connecting a closure body and lid.

It would be beneficial if such an improved hinge structure design could also optionally accommodate a design that permits the hinge structure to provide the desired opening and closing angle range for the lid. A hinge structure with such a capability can provide performance features that are desirable in particular applications.

Also, it would be desirable if such an improved hinge structure could be readily incorporated in a closure that would accommodate efficient, high quality, large volume manufacturing techniques with a reduced product reject rate.

Further, such an improved hinge structure should advantageously accommodate its use in closures with a variety of conventional containers having a variety of conventional container finishes, such as conventional threaded or snap-fit attachment configurations.

The present invention provides an improved hinge structure which can accommodate designs having one or more of the above-discussed benefits and features.

SUMMARY OF THE INVENTION

According to the present invention, a closure, having a hinge structure connecting a closure lid to the base or body of the closure, is provided for being mounted to, or formed as a unitary part of, a container that has an opening to the container interior where a product may be stored.

The closure base or body is adapted for extending from the container at the opening and defines a discharge aperture for communicating with the opening.

The lid is movable between a closed position occluding the aperture and an open position spaced from the aperture.

The hinge structure is a continuous hinge structure that is molded unitary with the body and lid to include (a) a web having a narrow portion and at least one wider end, (b) a body hinge connecting the body to the web along one side of the web and having at least one end edge, and (c) a lid hinge connecting the lid to the web along the other side of the web and having at least one end edge.

A special stress-relief recess is defined at an end edge of the hinge in either the closure body or lid or both. Preferably, if the body hinge has two end edges, then a stress-relief recess is defined at least in the body adjacent each end edge of the body hinge. More preferably, the lid also includes a stress-relief recess at each end edge of the lid hinge.

In the preferred form of the invention, at each end edge of the body hinge, the body recess extends both (1) into the body in the direction away from the side of the body hinge, and (2) away from the body hinge end edge in the direction laterally away from the end edge of the body hinge.

In the preferred form of the invention, at each end edge of the lid hinge, the lid recess extends both (1) into the lid in the direction away from the side of the lid hinge, and (2) away from the lid hinge end edge in the direction laterally away from the end edge of the lid hinge.

In the preferred form of the hinge structure of the present invention, the hinge structure is of the type that provides a bistable, snap-action.

The preferred form of the hinge structure includes a web having a narrow, central portion between two wider ends which each defines a lateral edge. The hinge structure also includes an arcuate, lid hinge connecting the lid to the web along one side of the web between the lateral edges of the web. The hinge structure includes an arcuate, body hinge connecting the closure base or body to the web along another side of the web between the lateral edges of the web. The web has two spaced-apart regions of reduced thickness. The reduced thickness regions are located between, and are reduced in thickness relative to, the arcuate hinges. Each reduced thickness region extends to one of the lateral edges of the web.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
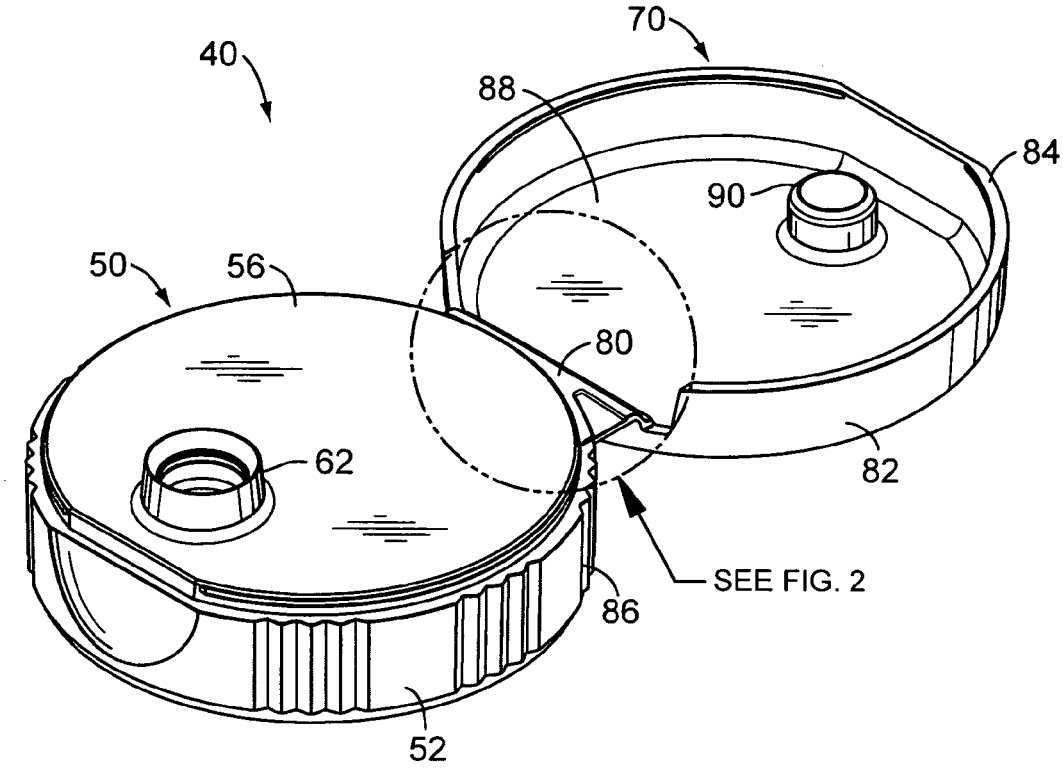
FIG. 1 is an isometric view of a first embodiment of a hinge structure of the present invention as incorporated in a closure shown in the as molded open position.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, a closure incorporating the hinge structure of this invention is described in various positions, and terms such as upper, lower, horizontal, etc., are used with reference to these positions. It will be understood, however, that the closure may be manufactured, stored, and used in orientations other than the ones described.

With reference to the figures, a first embodiment of a hinge structure of the present invention is illustrated in FIGS. 1-7 as incorporated in a closure represented generally in some of those figures by reference number 40. The closure 40 is adapted to be disposed on a container (not illustrated), which may have a conventional mouth or opening formed by a neck or other suitable structure.

The container may be stored and used in an upright orientation wherein the closure 40 is at the top of the container. The container may also be normally stored in an inverted position (not illustrated). When stored in the inverted position, the container employs the closure 40 as a support base.

Although the container, per se, does not form a part of the broadest aspects of the present invention, per se, it will be appreciated that at least a body or base portion of the closure 40 of the present invention optionally may be provided as a unitary portion, or extension, of the top of the container. However, in the preferred embodiment illustrated, the closure 40 is a separate article or unit (e.g., a dispensing closure 40) which is adapted to be removably, or non-removably, installed on a previously manufactured container that has an opening to the container interior.

The illustrated, preferred embodiment of the closure 40 is adapted to be used with a container having an opening to provide access to the container interior and to a product contained therein. The closure 40 can be used to dispense with many materials, including, but not limited to, relatively low or high viscosity liquids, creams, gels, suspensions, mixtures, lotions, etc. (such as a material constituting a food product, a beverage product, a personal care product, an industrial or household cleaning product, or other compositions of matter (e.g., compositions for use in activities involving manufacturing, commercial or household maintenance, construction, agriculture, medical treatment, military operations, etc.)).

The container with which the closure 40 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure so as to suck the material out through the open closure.

It is presently contemplated that many applications employing the closure 40 will conveniently be realized by molding the closure 40 from suitable thermoplastic material or materials. In the preferred embodiment illustrated, the closure could be molded from a suitable thermoplastic material, such as, but not limited to, polypropylene.

The closure 40 includes a base or body 50 (FIG. 1) for being mounted to the container. The base or body 50 includes a skirt 52 (FIG. 1) which has a conventional internal snap-fit bead or groove (not visible) or other suitable means for engaging suitable cooperating means, such as a mating bead or grove (not visible), on the container so as to secure the closure base or body 50 to the container. The closure base or body 50 could alternatively include an interior, annular connector wall with internal threads for engaging external threads on the container. Throughout this specification, the terms "base" and "body" will be used interchangeably.

At the top of the closure base skirt 52, the closure base 50 has a transverse deck 56 (FIG. 1) which extends over the upper, distal end of the container when the closure 40 is mounted on the container. As illustrated in FIG. 1, the closure base deck 56 has a spout 62 projecting upwardly to define a discharge aperture over the container neck opening. The deck 56 typically has a downwardly extending, annular, internal seal structure (not visible) which is received against the inner edge of the container opening so as to provide a leak-tight seal between the closure base deck 56 and the container.

Figure 2:
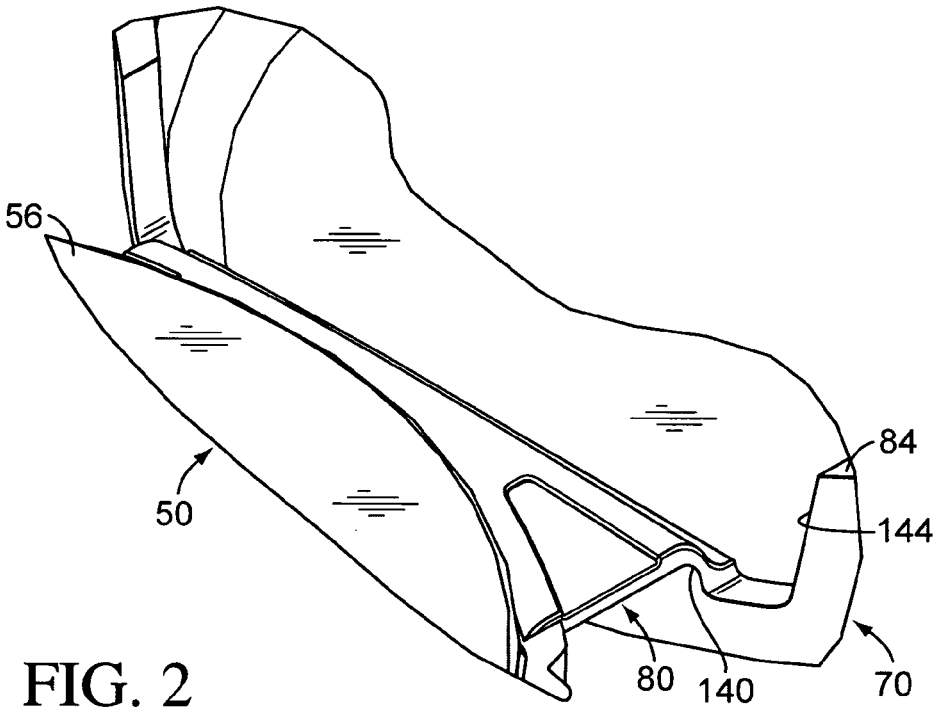
FIG. 2 is a fragmentary, isometric view of the area within the broken line circle designated FIG. 2 in FIG. 1.

The closure 40 includes a lid 70 (FIG. 1) connected to the base 50 with a hinge structure 80 (FIGS. 1 and 2). The lid 70 includes a peripheral skirt 82 (FIG. 1) defining a peripheral termination surface 84. The lid peripheral termination surface 84 is adapted to contact, or at least confront, the closure base 50 when the lid 70 is closed. Preferably, as illustrated in FIG. 1, the closure base 50 defines a peripheral shoulder 86 recessed below the main portion of the deck 56, and the recessed shoulder 86 confronts the surface 84 of the lid skirt 82 when the lid 70 is closed.

The closure lid 70 includes a transverse deck or cover 88 (FIG. 1). Extending from the underside of the lid cover 88 is an annular member 90 which is adapted to be received in, and sealingly engage the interior of, the closure base spout 62 when the lid 70 is closed.

The hinge structure 80 is integrally molded as a unitary part of the closure with the base 50 and lid 70. One preferred material for molding the closure is polypropylene. It has been found that this material provides a relatively strong, durable closure. The material functions in the hinge structure 80 with desirable biasing forces, has the capability for withstanding typical loads imposed by a user of the closure when the user opens and closes the lid 70, and has the capability for accommodating a relatively high number of opening and closing cycles without failure.

Figure 4:
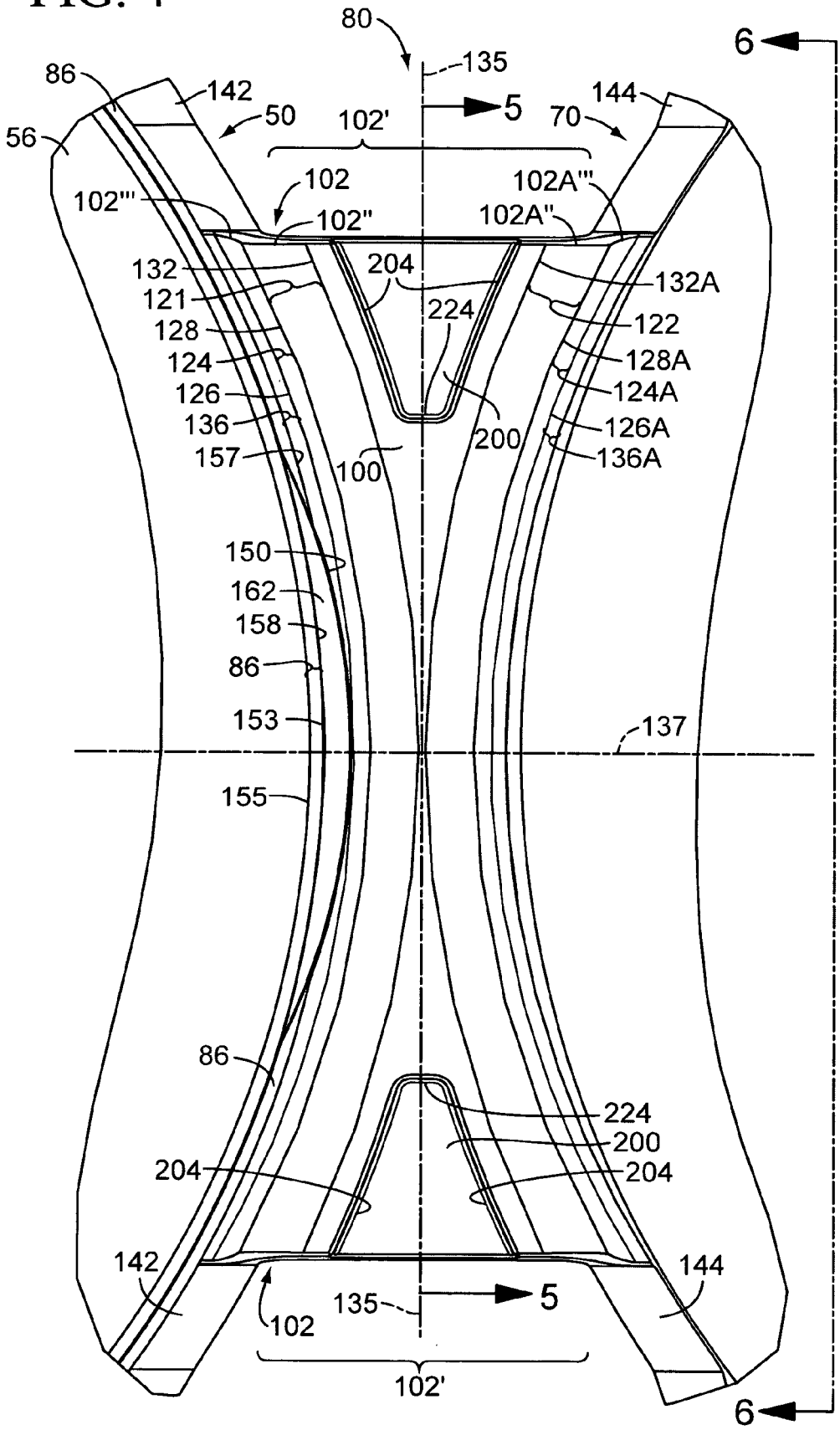
FIG. 4 is a fragmentary, top plan view of the hinge structure shown in FIG. 3.

As illustrated in FIG. 4, the preferred form of the hinge structure 80 includes a web 100 having a central, narrow portion between two wider lateral edges or ends 102. In the preferred embodiment illustrated, when the lid 70 is open, the two lateral edges or ends 102 are generally or substantially parallel. The hinge structure 80 includes some of the basic features disclosed in U.S. Pat. No. 6,321,323 which is incorporated herein by reference thereto to the extent not inconsistent herewith.

Figure 3:
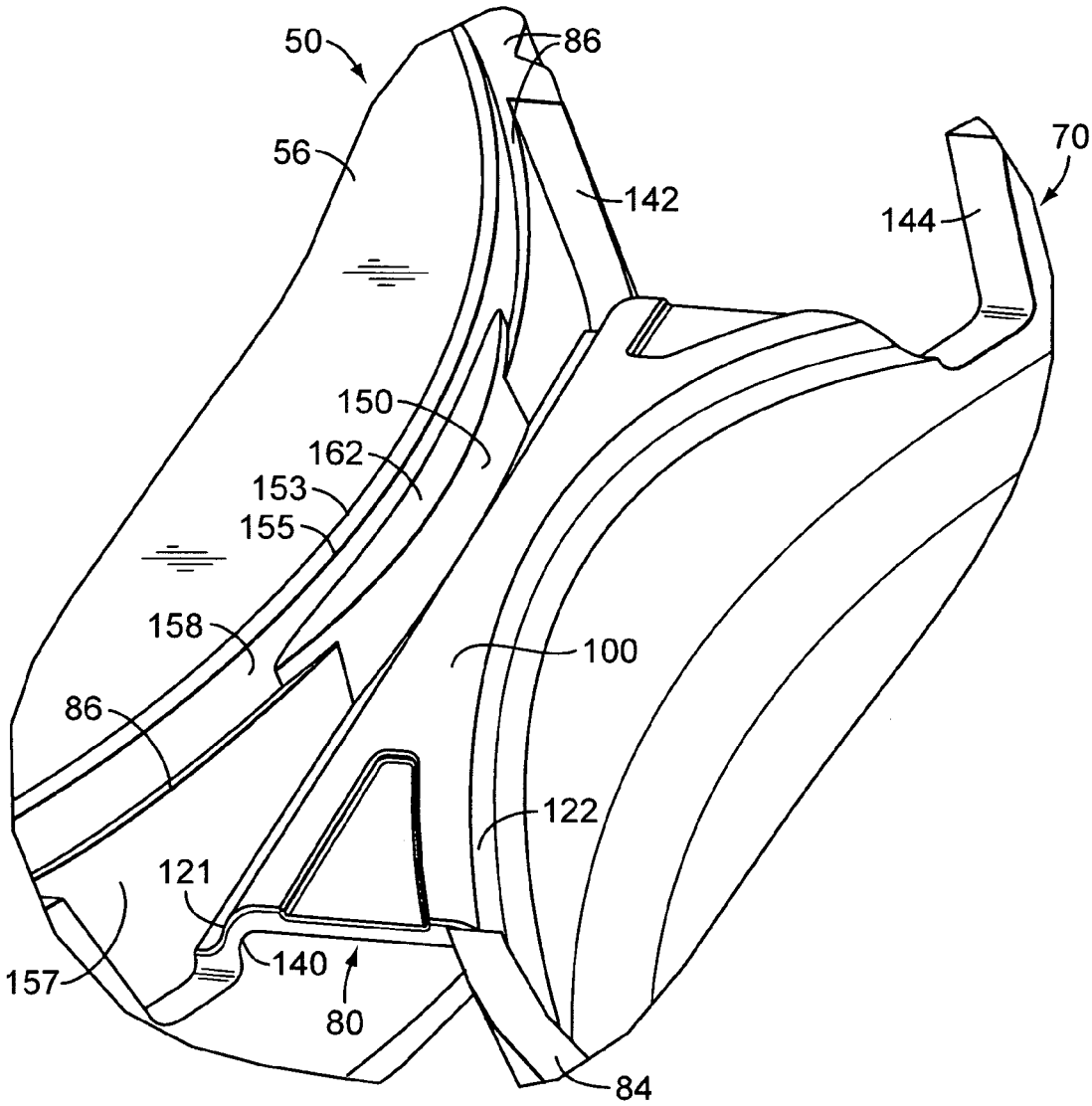
FIG. 3 is a view similar to FIG. 2, but FIG. 3 is taken from a slightly different perspective.
Figure 6:
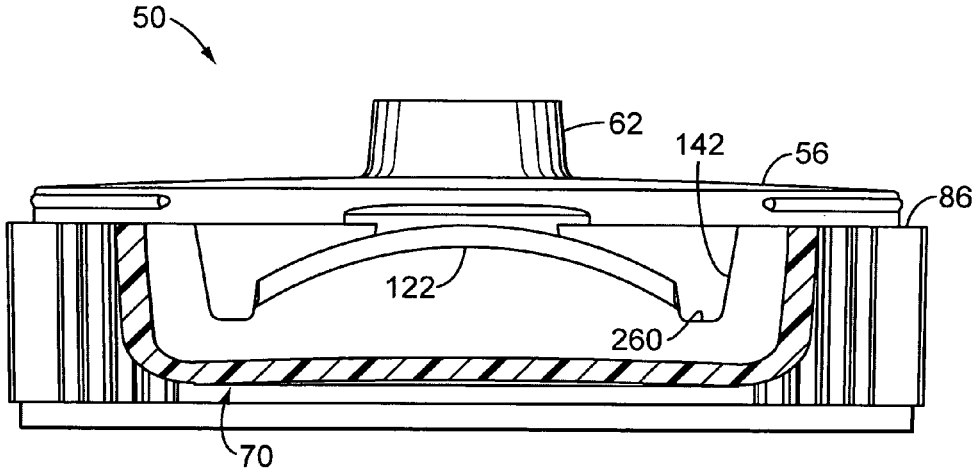
FIG. 6 is a cross-sectional view taken generally along the plane 6-6 in FIG. 4.

As shown in FIG. 4, a first, arcuate hinge, or body hinge, 121 connects the body or base 50 to the web 100 along one side of the web 100 between the ends 102. A second, arcuate hinge, or lid hinge, 122 connects the lid 70 to the web 100 along another side of web 100 between the ends 102. As illustrated in FIG. 4, the first hinge 121 lies on an arc that is generally concentric with the arc defining an adjacent peripheral portion of the closure base 50, and the second hinge 122 lies on an arc defining an adjacent peripheral portion of the lid 70. As illustrated in FIGS. 3, 4, and 6, the first hinge 121 lies in an upwardly convex curve on the side of the closure base 50, and the second hinge 122 lies on an upwardly concave curve on the side of the closure lid 70.

In a preferred embodiment as illustrated in FIGS. 1-7, the inner surface of the first hinge 121 has a particular configuration when the lid 70 is fully open. Specifically, with reference to FIG. 4, the inner surface of the first hinge 121 (when the lid 70 is fully open) has a curved, radius surface defined between the arcuate line 128 and another arcuate line 132. Adjacent to the base side of the hinge 121 there is a radius surface 124 defined between the arcuate line 128 and an arcuate line 126. The arcuate line 126 defines the locus of tangency between the radius surface 124 and an adjacent shoulder surface 136 on the base 50. The arcuate line 128 defines the locus of tangency between the radius surface 124 and the radius surface of the first hinge 121. The arcuate line 132 defines the locus of tangency between the radius surface of the first hinge 121 and the adjacent portion of the web 100.

In a preferred, contemplated commercial embodiment wherein the closure 40 is fabricated from polypropylene, the radius of the surface 124 is 0.01 inch, the radius of the upwardly facing inner surface of the hinge 121 (as viewed in FIG. 4) is 0.03 inch, and the thickness of the web 100 along the line 132 is 0.012 inch.

The second hinge 122 has a configuration generally identical to that of the first hinge 121, except that the second hinge 122, of course, is oriented in the opposite direction to connect the web 100 to the lid 70. When the lid is fully opened (FIG. 4), the inner surface of the second hinge 122 has a curved, radius surface defined between an arcuate line 128A (FIG. 4) and an arcuate line 132A (FIG. 4). Along the lid side of the second hinge 122 there is radius surface 124A (FIG. 4). The radius surface 124A is defined the between the arcuate line 128A and an arcuate line 126A.

The arcuate line 126A defines the locus of tangency between the radius surface 124A and an adjacent shoulder 136A on the lid 70. The arcuate line 128A defines the locus of tangency between the radius surface 124A and the adjacent radius surface of the second hinge 122. The line 132A defines the locus of tangency between the radius surface of the second hinge 122 and the adjacent portion of the web 100.

The second hinge 122 preferably has the same configuration and dimensions as the first hinge 121. Therefore, the radius of surface 124A and the radius of the surface of the second hinge 122 are equal to the radius of surface 124 and the radius of the surface of the first hinge 121, respectively.

With reference to FIGS. 2 and 3, when the lid 70 is fully open, the radius surface on the outside (exterior) surface of each hinge 121 and 122 along the exterior of the web 100 is designated by the reference numeral 140. In a preferred, contemplated commercial embodiment, the radius of the surface 140 is about 0.012 inch, but at the center of the hinge the radius is 0.010 inch and at each lateral edge the radius is 0.015 inch with the radius gradually increasing from the center to the two lateral edges.

The hinge structure 80 is accommodated in the closure base 50 by a notch 142 defined in the closure base skirt 52 (FIG. 3). Similarly, the hinge structure 80 is accommodated in the closure lid 70 by a notch 144 in the closure lid skirt 82 (FIG. 3).

Preferably, the web 100 is substantially symmetric about a centerline 135 (FIG. 4). Another line 137 is perpendicular to the centerline 135 and passes through the centers of the closure base 50 and closure lid 70. The distance between the centerline 135 and the intersection of the line 137 with the hinge 121 equals the distance between the centerline 135 and the intersection of the line 137 with the hinge 122.

Typically, the maximum outside dimensions of the shoulder 86 on the closure base skirt 52 is about 0.01 inch greater than the corresponding maximum outside dimensions of the lid skirt 82 at the lid skirt confronting surface 84. As a consequence, the midpoint of the hinge structure 80 along the line 137 is offset slightly toward the lid 70 compared to the point mid-way between the centers of the lid 70 and base 50 (on the intersection of line 137).

The central portion web 100 of the hinge structure 80 is narrower than the two ends 102. The widest part of the hinge structure 80 occurs at each lateral edge or end 102. Preferably, the widths of the two lateral edges or ends 102 are equal. A major portion of the width of each lateral edge or end 102 is defined line segment 102' (FIG. 4) which preferably defines a straight line edge when the lid 70 is in the full open condition. The segment 102' is preferably symmetrically disposed relative to the longitudinal centerline 135 of the hinge structure 80. At one end of the segment 102', the end of the first hinge 121 is defined by an edge 102", and at the other end of the segment 102' the end of the second hinge 122 is defined by an edge 102A".

Each end of the radius surface 124 is defined by an edge 102'", and each end of the radius surface 124A is defined by an edge 102A'". When the lid 70 is closed (FIG. 7), the stress tends to cause a slight curvature of each end segment 102' of each end 102 of the web 100.

In the preferred embodiment illustrated in FIGS. 1-7, the shoulder 136 decreases in width from each end of the hinge structure 80 toward the middle of the hinge structure 80 where the width of the body side shoulder 136 becomes very small or, preferably, substantially disappears. This occurs because a vertically oriented abutment surface 150 (FIGS. 3 and 4) is provided for controlling the position of the web 100 upon the closing or opening of the lid 70. In the preferred embodiment illustrated, the abutment surface 150 is molded as a unitary part of the closure base 50.

The abutment surface 150 projects outwardly from the closure base 50. The closure base 50 has vertically oriented, wall portions 157 (FIGS. 3 and 4) which each extends from one end of the notches 142 and merges with the abutment surface 150. The closure base 50 also has a generally vertically oriented, arcuate surface 158 (FIGS. 4 and 5) which extends from the top surface of the shoulder 86 and beyond the top of the vertical abutment surface 150. The arcuate surface 158 extends around the periphery of the closure base deck 56, and the peripheral shoulder 86 projects outwardly therefrom on either side of the abutment surface 150. The peripheral edge of the deck 56 is rounded. That is, the periphery of the deck 56 has a convex radius surface defined between an upper, circular, tangent line 155 and a lower, circular tangent line 153 at the top of the vertical surface 158.

The abutment surface 150 projects outwardly from the surface 158 as shown in FIG. 3. A horizontal surface or ledge 162 is defined at the top of the abutment surface 150 and projects from the arcuate, vertical surface 158. The outer edge (i.e., top edge) of the ledge 162 may be defined by a small convex radius surface which merges with the vertical abutment surface 150. In a presently contemplated commercial embodiment, the radius surface has a radius of about 0.01 inch.

The arcuate, body hinge 121 is spaced below the deck 56, below the ledge 162 at the top of the abutment surface 150, and below the closure base shoulder surface 86.

In the region of the hinge structure 80, the closure base notch 142 in the closure base wall 52 is defined along its bottom by the shoulder 136 (FIG. 4) which decreases in width toward the center of the hinge structure 80. Adjacent the central portion of the hinge structure 80, the width of the shoulder surface 136 decreases to nearly zero as the protruding abutment surface 150 projects further outwardly into the surface 136.

The radius of the arcuate, vertical surface 158 (at the outer edge of the deck 56 adjacent the hinge structure 80) is larger than the radius of the exterior, vertical surface of the abutment surface 150. Moreover, both the inner and outer radii of the shoulder 136 are larger than the radius of the exterior, vertical surface of the abutment surface 150.

The abutment surface 150 is preferably an arcuate, vertically oriented surface which is preferably positioned symmetrically relative to the web ends 102 so that the surface 150 projects outwardly from the cylindrical surface 158 into the shoulder 136. In the preferred illustrated embodiment, the abutment surface 150, at the centerline 137 of the hinge structure 80, may be characterized as extending both (1) upwardly to an elevation above the base shoulder surface 86, and (2) downwardly to the shoulder 136 slightly below the first hinge 121 (i.e., body hinge 121).

The ledge 162 at the top of the abutment surface 150 is recessed below the upper surface of the base deck 56. The elevation of the abutment ledge 162 is established so that the lid shoulder surface 136A (FIG. 4) will not interfere with the abutment surface ledge 162 when the lid 70 is closed.

The abutment surface 150 establishes a vertically oriented abutment beyond which the hinge web 100 cannot move when the lid 70 is closed and opened. The abutment surface 150 controls the position of the hinge structure web 100 upon the closing and opening of the lid 70. Preferably, the abutment surface 150 has a vertical height, at the location along the center of the hinge structure 80 (on the centerline 137 of the centers of the closure base 50 and lid 70), which is at or above the second hinge 122 when the lid 70 is fully closed. In other words, at the longitudinal center of the hinge structure 80 (on centerline 137), the abutment surface 150 extends upwardly above hinge 121 for a distance that is greater than the shortest distance between the hinges 121 and 122.

Upon the closing or opening of the lid 70, the hinge structure web 100 engages the abutment surface 150 so that the position of the web 100 is controlled as described in more detail in U.S. Pat. No. 5,642,824. In general, the web 100 bows inwardly toward and against the abutment surface 150 when the lid 70 is partially closed. The abutment surface 150 should preferably extend adjacent the web central portion 100 from the first hinge 121 toward the second hinge 122 (when the lid is closed) more than one-half the shortest distance between the hinges (as measured at the centerline 137 between the web ends 102). However, preferably, the abutment surface 150 at the centerline 137 of the hinge structure 80 extends all the way to, and slightly beyond, the hinge 122 when the lid 70 is closed, and this is presently believed to provide the most accurate control.

The radial extent of the projecting abutment surface 150 can be easily varied during manufacturing according to the hinge characteristics that are desired for a particular application. If the abutment surface 150 projects outwardly a considerable amount, then the hinge structure web 100 contacts the abutment surface 150 earlier during the closing process. If the projection of the abutment surface 150 is less, then the hinge structure web 100 would contact the abutment surface 150 later in the closing process, or only when the lid is substantially 100 percent closed.

When the abutment surface 150 projects further outwardly, the biasing action of the hinge structure 80 can be made greater to provide an opening and closing action with more "snap" or force. When the projection of the abutment surface 150 is reduced, the biasing force can be made less, and the opening and closing action of the closure will be "softer." Further, when the abutment surface 150 projects further outwardly, the full open position of the lid 70 defines a greater opening angle relative to the closure base 50 than if the abutment surface 150 projects outwardly a lesser amount.

In a presently contemplated commercial embodiment for one typical size closure, the radius of the abutment surface 150 is 0.553 inch and the diameter of the arcuate surface 158 from which it projects is about 1.320 inch. The height of the abutment surface 150 (at the ledge surface 162) is 0.03 inch from the molding parting plane defined by the inner surface of the hinge web 100 when the lid is in the as-molded, fully opened position. In contrast, in the contemplated commercial embodiment, when the lid 70 is in the closed position, the lowest part of the second hinge 122 (at the centerline 137 between the hinge web ends 102) would be 0.005 inch lower than the abutment surface ledge 162. Thus, the abutment surface 150 extends upward slightly beyond the lowest point of the lid hinge 122 when the lid 70 is closed.

The incorporation of the abutment surface 150 in the hinge structure 80 of the present invention is not a necessary part of the present invention. The hinge structure of the present invention may be employed with other hinge structures that do not employ the abutment surface 150 and/or that employ a fixed center hinge pivot between the two spaced-apart hinges 121 and 122.

Generally, in a presently contemplated commercial embodiment, it is desired to provide a hinge structure 80 in which the strain in the hinge structure 80 is not excessive when the lid 70 is in the fully closed position. This minimizes the tendency of the hinge structure 80 to loose its snap-action biasing capability when the lid 70 is maintained closed for long periods of time in the fully closed position.

In alternate designs wherein the hinge structure 80 would have a greater amount of strain when the lid 70 is in the fully closed position, the strain could, over time, result in some creep of the closure material and subsequent relaxation. This would reduce the amount of biasing force that the hinge structure would exert during opening and closing of the lid.

The operation of the hinge structure 80, in so far as the structure has been described herein, is described in detail in the U.S. Pat. No. 6,321,923. Generally, as the hinge structure 80 is moved from the opened to the closed position, and vice versa, the changes in the distance between the hinges 121 and 122 near the ends 102 relative to the smaller changes in the distance between the hinges 121 and 122 at the centerline 137 create a significant tension force or "stretch" at the outer most ends 102. This causes the hinge structure 80 to be unstable in any position between the full open and full closed positions. This results in the hinge structure 80 having an inherent bias (when the lid is between the full open and full closed positions). This urges the hinge structure 80 to assume one of the two stable positions (either full open or full closed).

The stretch or tension in the hinge structure 80 serves to create a temporary deformation within the hinge structure that is sufficient to move the lid 70 automatically toward the closed position or toward the open position when it is released from any position between the full open and full closed positions. The lid will automatically move to the full closed position if it is released while it is initially closer to the full closed position. On the other hand, the lid will automatically move to the full open position if the lid is released from an initial position which is closer to the full open position.

It will be appreciated that the full open orientation of the closure illustrated of the figures corresponds to the initial, as-molded position. This as-molded position preferably has the base and lid opened approximately 180°. Once the lid 70 is first closed, and then the lid 70 is thereafter opened and maintained free of any exterior forces, the hinge structure will typically maintain the lid 70 in a "full open" position which has an opening angle somewhat less than the substantially 180° open angle of the original, as-molded, open orientation.

The hinge structure 80 is preferably configured to provide a selected stress, or particular distribution of stress, along the outer, lateral edges or ends 102 of the web 100. In particular, in one optional configuration, it has been found that the reduction of the web thickness at the regions 200 (FIG. 4) increases the stress at the midpoint of, and along, each lateral edge or end 102 adjacent to the region 200. This causes a reduction in stress where the edges of the web ends 102 connect to the closure body 50 and closure lid 70. It is in these connection locations where failure or fracture of the hinge structure 80 is most likely to be initiated. Thus, a reduction in the stresses at these four points of the hinge structure 80 will reduce the likelihood of the failure of the hinge structure 80.

In one presently preferred, but optional arrangement, embodiment of the structure 80, the web 100 includes two spaced-apart regions 200 (FIG. 4) which define a reduced thickness in the web between, and relative to, the hinges 121 and 122.

Preferably, each region 200 extends laterally to the adjacent lateral edge or end 102 of the web 100.

In a presently preferred embodiment, the web 100 has a generally uniform thickness between the hinges 121 and 122, and each region 200 of reduced thickness results in a reduction of the web thickness of about one third. In the preferred embodiment illustrated in FIGS. 1-7, the web 100 may be characterized as having (1) an inside surface facing toward the closure base and lid (when the lid is in the closed position), and (2) an outside surface oppositely facing from the inside surface. Each reduced thickness region 200 is defined on the web inside surface by a generally trapezoid shaped recess having one side along one of the lateral edges 102. The depth of the recess in the illustrated preferred embodiment is about one third of the thickness of the adjacent, uniform thickness portion of the web 100. It is contemplated that in a polypropylene hinge structure where the generally uniform thickness portion of the web has a thickness between about 0.010 inch and 0.015 inch, and preferably about 0.012 inch, the preferred range of the thickness of the reduced thickness region 200 is at least about ½ or more of the thickness of the adjacent, uniform thickness portion of the web.

As can be seen in FIG. 4, each trapezoid shaped recess at each region 200 includes two side walls 204 which are each parallel to or concentric with an adjacent hinge 121 or 122. As shown in FIG. 4, the width of the reduced thickness region 200 is defined on one end by an end wall 224 which is generally parallel to the web lateral edge or end 102. The top edges of the recess side walls 204 and the top edge of the recess end wall 224 are preferably convex surfaces that merge with the adjacent top surface of the web 100. The bottom portions of the recess side walls 204 and end wall 224 are preferably concave surfaces that merge with the adjacent bottom flat surface of the recess 200. This functions to reduce stress concentrations within the web 100 around each recess region 200 inwardly of the web lateral edge or end 102.

The actual stress at the midpoint of the length of the web lateral edge or end 102 adjacent to the reduced thickness region 200 is greater than the stress at the midpoint of the web edge in the prior art hinge web shown in U.S. Pat. No. 5,642,824 which has either a substantially uniform thickness or an increased thickness along the edge between the hinges. In the preferred form of a closure embodying the present invention, the stress along the lateral edge or end 102 of the web 100 is greatest at the midpoint of the length of the lateral edge or end 102, and the stress decreases outwardly from the center portion of the lateral edge or end 102 toward the hinges 121 and 122. The greater stress at the center of each lateral edge or end 102 reduces the stresses where the end 102 of the web 100 connects with the hinges 121 and 122. The stress reductions at these four points or regions of the hinge structure 80 minimize the likelihood of hinge failure initiating at these points.

In an alternate configuration (not illustrated), web 100 could also include an exterior region of reduced thickness on the other side of the web (i.e., on the exterior side of the web 100), and such an exterior region of reduced thickness could have the same configuration as the reduced thickness region 200 which could remain on the interior surface of the web 100 or which could be omitted altogether.

It will be appreciated that the shapes of the reduced thickness regions (such as regions 200 in the preferred, first embodiment of the hinge structure illustrated in FIGS. 1-7) may be altered to provide varying degrees of effectiveness in producing a desired distribution of stress along a lateral edge or end of the hinge web. Thus, this permits control of the amount of stress reduction at the four regions of the hinge structure where the lateral edges of the web are connected to hinges. The stress reduction is of particular importance when the hinge structure is subjected to stress during normal operation, such as when the hinge structure is moved away from its initially, as-molded, condition.

In yet another arrangement (not illustrated), reduced thickness regions 200 may be omitted altogether, and the stress concentrations at the ends of the hinges 121 and 122 can be reduced solely by employing the novel structure of the present invention described in detail hereinafter. However, in the preferred embodiment, the novel structure of the present invention is employed conjunction with some form reduced thickness regions 200 in the web 100, preferably as illustrated in FIGS. 1-7.

Figure 7:
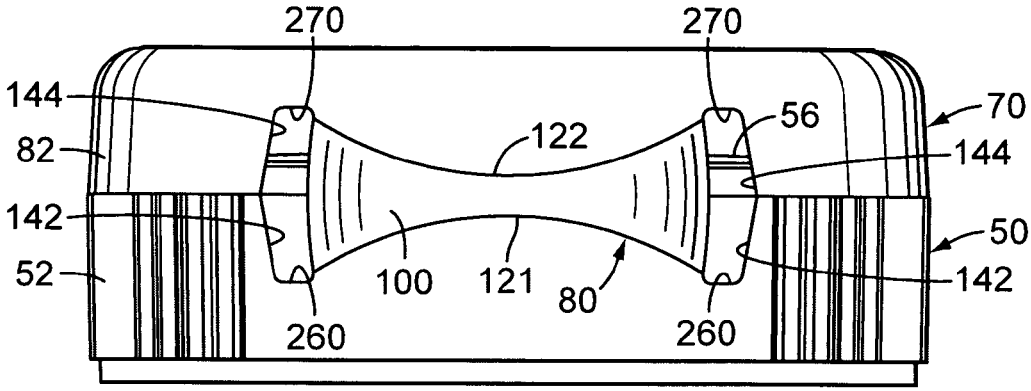
FIG. 7 is a rear elevational view of the closure in the closed condition.
Figure 8:
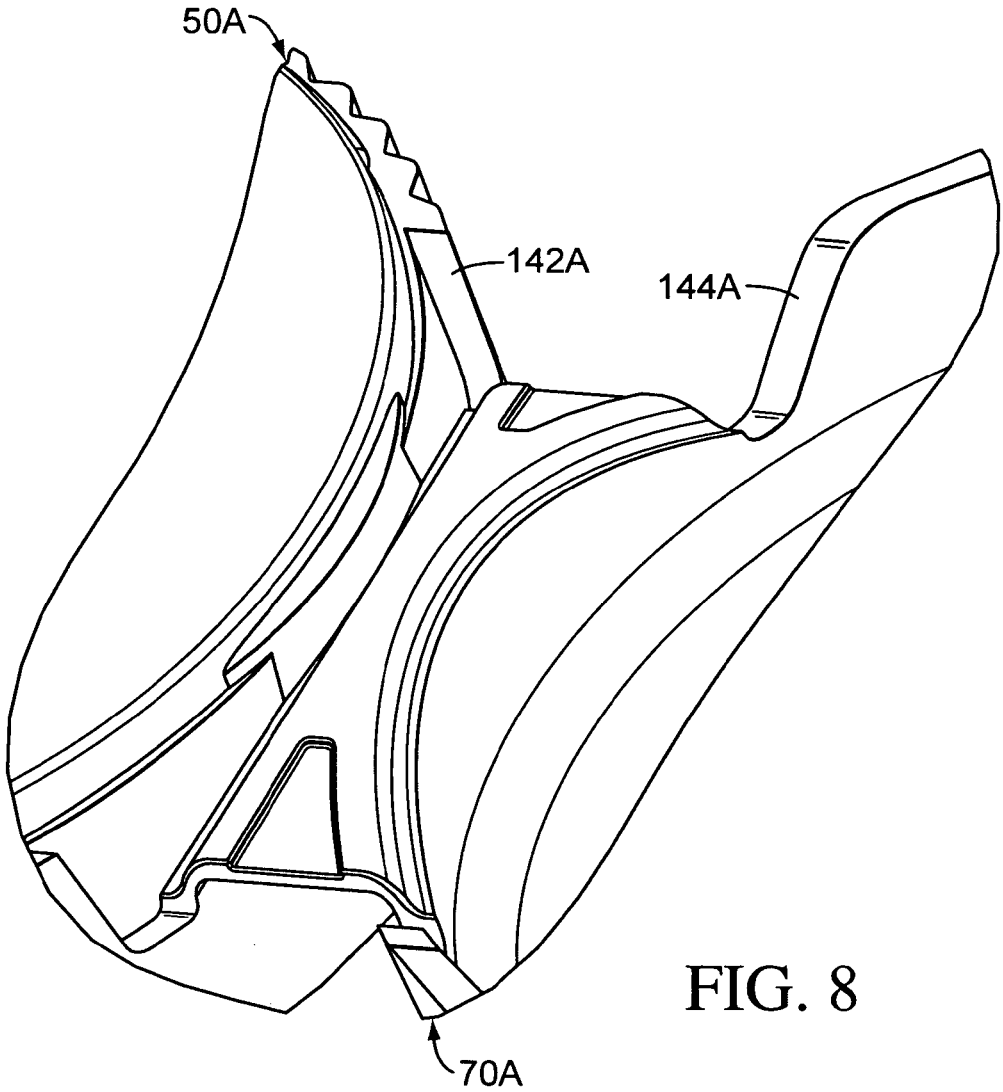
FIG. 8 is a view similar to FIG. 3, but FIG. 8 shows a second embodiment of the hinge structure.
Figure 9:
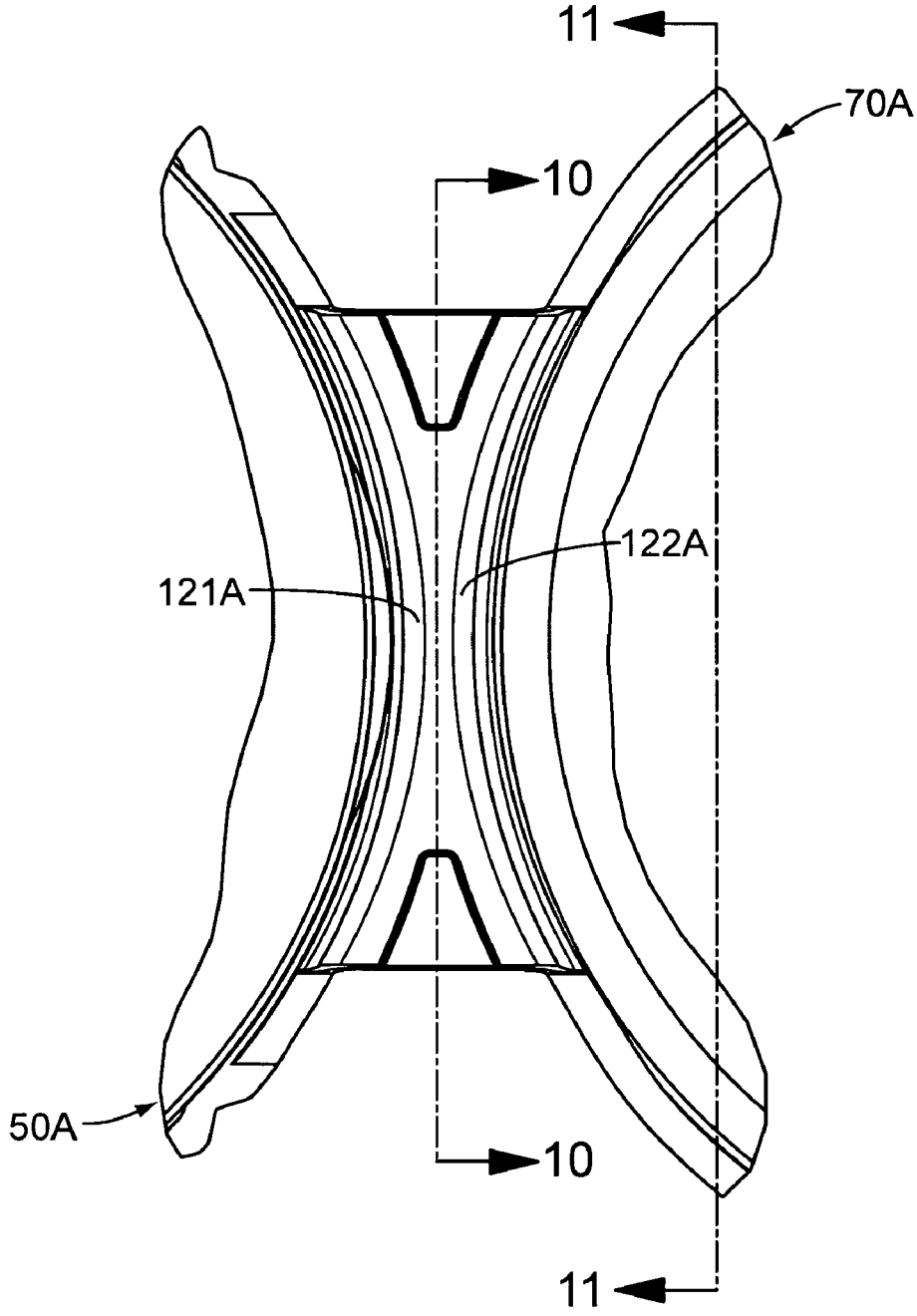
FIG. 9 is a fragmentary, top plan view of the second embodiment of the hinge structure shown in FIG. 8.
Figure 10:
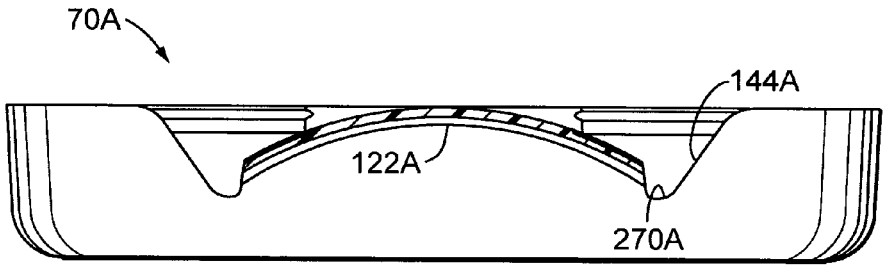
FIG. 10 is a cross-sectional view taken generally along the plane 10-10 in FIG. 9.
Figure 11:
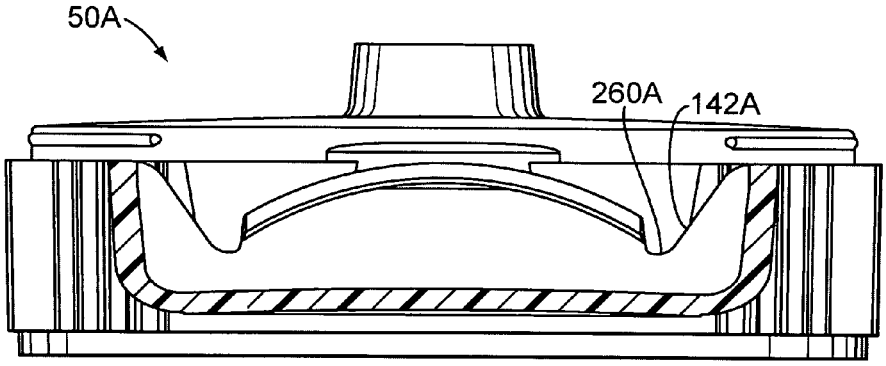
FIG. 11 is a cross-sectional view taken generally along the plane 11-11 in FIG. 9.

According to the present invention, a unique relief pocket or stress relief recess is provided at one or both the ends of either or both of the hinges 121 and 122. Preferably, the stress relief recesses are provided at each end edge of both the body hinge 121 and the lid hinge 122. As can be seen in FIGS. 3, 4, and 7, the notch 142 in the skirt of the closure base or body 50 accommodates a portion of the web 100, and a notch 144 in the skirt of the closure lid accommodates a portion of the web 100. At each end of the closure body hinge 121 (as can be seen in FIG. 7), the notch 142 in the closure body 50 defines a recess that is adjacent the end edge of the closure body hinge 121 and that extends in the direction laterally away from the end edge of the closure body hinge 121. Also, the recess extends downwardly in the skirt 52 of the body 50 in the direction away from the side of the body hinge 121. Specifically, with reference to FIG. 7, the recess extends down to a generally horizontal edge 260, and that edge 260 is "below" the end of the adjacent body hinge 121.

The notch 144 in the skirt 82 of the lid 70 defines a recess adjacent each end of the lid hinge 122. In particular, the lid recess extends away from the end edge of the lid hinge 122 in the direction laterally away from the end edge of the lid hinge 122. The recess also extends upwardly in the skirt 82 of the lid 70 in the direction away from the side of the lid hinge 122. In particular, and with reference to FIG. 7, the top of the recess at each end of the lid hinge 122 is defined by an upper, horizontal edge 270. The upper edge 270 is "above" the adjacent end of the lid hinge 122.

The above-described recess (that extends laterally beyond each hinge end and also in the direction away from the side of each hinge) creates a space between the ends of the hinge and the wall portions of the closure. This relieves the full height or extent of each hinge end at the wall portions of the closure where hinge breakage can often be initiated.

The geometry of the hinges 121 and 122 accommodates flexing and bending during opening and closing of the lid 70. The portions of the hinge structure which flex and bend during opening and closing are thus located away from areas that, during molding, might otherwise become stress points or stress regions where the two halves of the steel mold abut. Owing to the recesses at each end of the hinge structure, the connections of the hinge ends to the remaining portions of the closure structure are located away from the parting plane of the mold halves so that the region around each hinge end can be contained within one of the mold halves (e.g., the upper mold half or the lower mold half). Thus, during mold closure, the two halves of the mold do not abut at a location adjacent the hinge ends in a way that might otherwise create undesirable stress or stress concentrations.

In a presently preferred embodiment of the arrangement illustrated in FIG. 7 the dimensions of various features are as follows: (1) the recess bottom edge 260 is about 0.020 inch below the end of the adjacent body hinge 121, (2) the top edge 270 of the recess is about 0.020 inch above the end of the adjacent lid hinge 122, (3) and at each end of each hinge 121 and 122, the lateral distance between the hinge end and the outer edge of the recess or notch (142 in the body 50 or notch 144 in the lid 70) is about 0.042 inch (as measured horizontally parallel to the opening and closing plane of the closure). Such recess dimensions would be employed with typical size polypropylene closures having a nominal outside body diameter of between about 10 millimeters and about 100 millimeters. The present invention is not limited to embodiments having such recess dimensions and closures diameters.

Figure 5:
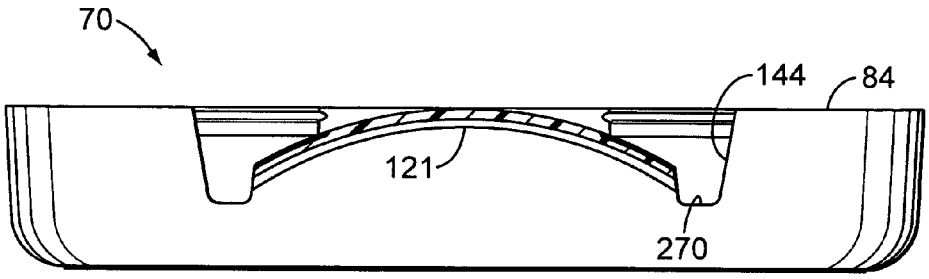
FIG. 5 is a cross-sectional view taken generally along the plane 5-5 in FIG. 4.

FIGS. 8-11 illustrate another closure that incorporates a variation of the shape of the stress-relief recesses of the present invention. In particular, the closure illustrated in FIGS. 8-11 includes a closure body 50A and a lid 70A. A closure body notch 142A extends further laterally, and slants further outwardly, compared to the first embodiment notch 142 (FIG. 6). Similarly, the closure lid 70A includes a notch 144A that extends further laterally, compared to the first embodiment closure lid notch 144 (FIG. 5).

The notch 142A in the closure body 50A defines a recess having a lower edge 260A located in the body 50A away from the side of the body hinge 121A at the end of the body hinge 121A. Similarly, the closure lid notch 144A defines a recess having an upper edge 270A located in the lid 70A away from the side of the lid hinge 122A at the end of the lid hinge 122A. The remaining portions of the hinge structure of the alternate embodiment of the closure may be identical to the remaining portions of the hinge structure discussed above for the first embodiment illustrated in FIGS. 1-7.

In yet another alternate configuration (not illustrated), the hinge structure may include a fixed, single, central axis and two spaced-apart triangular shaped webs. Each such triangular web is defined between the body hinge and the lid hinge, and can be located at an end of the central axis and oriented with an apex of the web at the axis end. Each such web can have a lateral, end edge opposite the apex at the fixed axis. Each such web could also have a reduced thickness region adjacent the lateral, end edge. One or more of the above-described inventive stress-relief recesses could be provided for such a hinge structure.

Typically, the hinge structure is initially molded in a fully opened condition. That is, when such a hinge structure is initially molded as part of a closure, the closure is molded with the lid in an initially open condition. After molding, the closure hinge structure is substantially stress-free. Stresses are developed within the hinge structure when the hinge structure is moved away from its initially molded, open condition (e.g., when the closure lid is moved away from the open condition toward the closed condition). The stress in the hinge structure reaches a maximum at the "over center" point (i.e., at an intermediate position between the closed and opened positions). The stress in the closure hinge structure is reduced somewhat when the lid has been moved to the fully closed position, but the hinge structure remains under sufficient stress to bias the lid to, and hold the lid at, the closed position. It is during the movement of the closure lid away from the fully opened condition toward the closed condition that the increased stresses can cause failure of the hinge. Because the present invention reduces the hinge operational stresses at the four regions around the ends of the two hinges, the hinge structure can be designed to accommodate many cycles of opening and closing without failure and/or can be designed with less material and/or with less expensive, but lower strength, materials.

It is seen that the present invention thus provides a closure with an improved hinge structure which is especially suitable for use wherein it is desired that the lid operate with a snap-action motion while moving to and from a closed position.

The hinge structure protrudes minimally from the rear of the closure when the closure lid is in the closed position. This is compatible with high speed closure applying machinery employed in conventional container product filling lines. This permits the closure to be used with containers processed at high line speeds.

It will be appreciated that a closure of the present invention includes a base and lid that may be connected with a multiple axis bistable hinge structure or with a single, fixed axis bistable hinge structure. The hinge structure web can optionally include reduced thickness regions, and the hinge structure can optionally incorporate a cooperating engaging abutment surface which can be designed to provide a small or large biasing force and a small or large lid opening angle.

It will also be appreciated that the closure may be provided with a variety of dispensing passage structures.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for a container that has an opening to the container interior where a product may be stored, said closure comprising:

(A) a body for extending from said container at said opening, and defining a discharge aperture for communicating with said opening;

(B) a lid movable between a closed position occluding said aperture and an open position spaced from said aperture;

(C) a continuous hinge structure molded unitary with said body and lid to include (a) a web having a narrow portion and at least one wider end, (b) a body hinge connecting said body to said web along one side of said web and having opposite end edges, and (c) a lid hinge connecting said lid to said web along the other side of said web and having opposite end edges;

and wherein the closure further includes either or both of the following features I and II:

(I) a body side stress-relief recess defined beyond said web in the body at each of said end edges of said body hinge, each said body recess defining an inner surface aligned with said body hinge and having a generally U-shaped configuration extending both (1) into said body in the direction away from and generally beneath the respective side of said body hinge, and (2) away from the respective body hinge end edge in the direction laterally away from the respective end edge of said body hinge, each said body recess having a surface which extends continuously from a vertically oriented wall portion of said body outwardly to an outwardly facing, vertically oriented surface of said body; and (II) a lid side stress-relief recess defined beyond said web in the lid at each of said end edges of each said lid hinge, each said lid recess defining an inner surface aligned with said lid hinge and having a generally U-shaped configuration extending both (1) into said lid in the direction away from and generally above the respective side of said lid hinge, and (2) away from the respective lid hinge end edge in the direction laterally away from the respective end edge of said lid hinge, each said lid recess having a surface which extends continuously from an inwardly facing, vertically oriented surface of said lid outwardly to an outwardly facing, vertically oriented surface of said lid.

2. The closure in accordance with claim 1 in which said one wider end defines a lateral edge;

a major portion of said web lateral edge is defined by a generally straight line segment when said hinge structure is fully opened; and a reduced thickness region is defined on one side surface of said web adjacent said web lateral edge.

3. The closure in accordance with claim 1 in which said closure is molded from one of the group of materials consisting of polypropylene and polyethylene.

4. The closure in accordance with claim 1 in which said body and lid each have an exterior wall which defines a notch for accommodating said web; and each said stress-relief recess is part of said notch.

5. The closure in accordance with claim 1 in which each said hinge, when the lid is in the open position, defines a radius surface; and said hinge structure includes a radius surface adjacent to each said hinge radius surface.

6. A closure in accordance with claim 1 in which said web is free of apertures.

7. The closure in accordance with claim 1 in which said web has (1) an inside surface facing toward said body and lid when said lid is in said closed position, and (2) an outside surface oppositely facing from said inside surface.

8. The closure in accordance with claim 1 in which said closure is a dispensing closure wherein said body is separate from, but releasably attachable to, said container around said container opening.

9. The closure in accordance with claim 1 in which said closure includes only said feature I of said features I and II.

* * * * *